United States Patent [19]

Mausbach

[11] 4,135,555

[45] Jan. 23, 1979

[54] METHOD OF FASTENING A SPIRAL ELEMENT TO A FABRIC TAPE FOR A SLIDING-CLAMP FASTENER

[75] Inventor: Karl Heinz Mausbach, Turin, Italy

[73] Assignee: 2 A S.p.A, Turin, Italy

[21] Appl. No.: 779,110

[22] Filed: Mar. 18, 1977

[30] Foreign Application Priority Data

Apr. 13, 1976 [IT] Italy ..... 67863 A/76

[51] Int. Cl.[2] ..... A44B 19/42

[52] U.S. Cl. ..... 139/384 B; 139/35; 24/205.16 C

[58] Field of Search ..... 139/384 B, 35, 432; 24/205.16 C

[56] References Cited

U.S. PATENT DOCUMENTS

| | | | |
|---|---|---|---|
| 3,403,706 | 10/1968 | Shackleton et al. | 139/432 |
| 3,807,462 | 4/1974 | Nogai | 24/205.16 C |
| 3,905,401 | 9/1975 | Steingruebner | 139/384 B |
| 3,976,106 | 8/1976 | Porepp | 139/384 B |

*Primary Examiner*—Henry S. Jaudon

*Attorney, Agent, or Firm*—Sughrue, Rothwell, Mion, Zinn and Macpeak

[57] ABSTRACT

A method for manufacturing a fabric tape for use in making sliding-clasp fasteners in which, during manufacture of the tape on a shuttleless loom, a spiral element which forms the teeth of the fastener is fed on to a marginal part of the tape opposite a selvedge. At least one warp thread in the marginal part of the tape is controlled by a heald and associated cam to form loops which project through and above the spiral element, and the loops, possibly together with a locking thread, are connected by an auxiliary lock stitch needle located above the spiral into a chain binding fastening the spiral element to the tape.

4 Claims, 9 Drawing Figures

METHOD OF FASTENING A SPIRAL ELEMENT TO A FABRIC TAPE FOR A SLIDING-CLAMP FASTENER

This invention relates to the manufacture of fabric tape for use in making sliding-clasp or "zip" fasteners, of the kind in which a helical plastics thread, herein referred to as a spiral element, is attached to form a set of teeth for cooperation with a sliding clasp.

More particularly, the invention concerns a method for fastening a spiral element to a fabric tape for use in making sliding-clasp fasteners, during manufacture of the tape. This invention also relates to a shuttleless loom for the manufacture of such tape by this method.

Methods are already known for attaching a spiral element of shaped, plastics thread which provides the teeth of a sliding-clasp fastener close to the edge of a tape during the weaving of the tape on a shuttleless loom.

One of these known methods consists in anchoring to the tape, arms of the spiral element which extend transverse the length of the tape, by means of warp threads of the fabric tape itself, each of which passes over alternate transverse arms of the spiral element in alternation with other warp threads in order to anchor the spiral element to the tape.

Another known method consists of forming a second layer of fabric above the spiral element which is superimposed on a marginal part of a foundation fabric tape. This second layer of fabric is formed by a second weft thread inserting member which operates in a plane above the spiral element, the spiral element being attached to the fabric of the foundation tape by the passage of at least one warp thread, at regular intervals, from one tape to the other.

These known methods require a considerable amount of yarn in order to attach the spiral element to the tape, and do not achieve a sufficiently strong attachment to ensure complete lack of relative movement between the spiral element and the tape, particularly in the longitudinal direction. Consequently, further fastenings are required to prevent disengagement of the spiral element from the tape. Another disadvantage of the known methods is the relatively easy, spontaneous opening of the completed fastener during sudden bendings of the latter about an axis perpendicular its length.

An object of the present invention is to provide a method of attaching a spiral element to a tape for a sliding-clasp fastener which avoids the above disadvantages.

According to the present invention, there is provided a method for the manufacture of a fabric tape for use in making sliding-clasp fasteners, of the type having a spiral element superimposed upon a marginal part of the tape opposite a selvedge and secured to the tape during the weaving thereof, characterised in that at least one of the warp threads located in the marginal part of the tape is formed into loops which are brought through the spiral element to project above the latter and are connected together above the spiral element to form a chain binding fastening the spiral element to the tape.

The warp thread may be passed over arms of the spiral element which extend substantially perpendicular the length of the tape, the said loops being formed directly above the arms, or alternatively the warp thread loops may be formed in and project above spaces between arms of the spiral element which extend substantially perpendicular the length of the tape. Preferably the chain binding comprises the loops of warp thread locked together by means of a locking thread.

According to a preferred embodiment of the method according to the invention the chain binding is formed by two warp threads located in the said marginal part of the tape, the locking thread being situated wholly above the spiral element.

According to a second aspect of the invention there is provided a shuttleless loom for the manufacture of a fabric tape for use in making sliding-clasp fasteners and for the attachment of a spiral element to a marginal part of the tape, opposite a selvedge, of the type having a reciprocating weft thread inserting member for inserting loops of a weft thread into open sheds of warp threads to form the tape, a lock stitch needle for connecting weft loops at one edge of the tape into a chain binding to form the selvedge and a cop through which the spiral element is fed onto the said marginal part of the tape, characterised in that the loom includes at least one heald for controlling the movement of a respective warp thread situated in the said marginal part of the tape beneath the spiral element to form loops which project through the spiral element, and an auxiliary lock stitch needle for connecting the warp loops above the spiral element into a chain binding to fasten the spiral element to the tape.

The auxiliary lock stitch needle is preferably disposed above and parallel to the length of the tape, in use of the loom, and is driven to carry out reciprocating movements longitudinally of the tape between an advanced position in which its hooked end is located above the end of the cop through which the spiral element is fed, and a withdrawn position, in which the hooked end is spaced from the cop and disposed above the tape which has been formed on the loom.

Preferably, the weft thread inserting member carries a guide member having a forked end for engaging a warp thread and carrying it into a position in which it can be grasped by the auxiliary lock-stitch needle, the guide member extending above and substantially perpendicular to the auxiliary lock stitch needle and being located directly above the weft thread inserting member.

The heald for controlling the movement of a respective warp thread is preferably located on the side of the cop opposite the lock stitch needle and is controlled by a cam to carry out repeated sequences of movements between an upper level in which the warp thread controlled by the heald can be engaged by the forked end of the guide member, and a lower level in which the warp thread lies below the plane in which the weft thread inserting member moves to insert loops of the weft thread in the open warp sheds.

In a preferred embodiment of the invention there are two said healds, each of which is controlled by a cam to carry out the said sequence of movements, the sequences of the two healds being staggered by the time needed for the insertion of a loop of the weft thread by the weft thread inserting member.

In the preferred embodiment each heald is controlled to carry out repeatedly the following sequence of movements: from the upper level, the heald descends to the lower level, rises to an intermediate level between the upper and lower levels and above the plane in which the weft thread inserting member moves, and again descends to the lower level before rising to the upper level to recommence the sequence.

In a further preferred embodiment of the invention there is provided, on that side of the cop opposite the lock stitch needle, a further heald through which is fed a locking thread, the further heald being controlled by a cam to carry out repeated sequences of movements between the upper level in which the locking thread can be engaged by the forked end of the guide member and a lower level above the plane in which the weft thread inserting member moves.

Preferably the cop is inclined to the plane of formation of the tape in use of the loom such that the spiral is fed downwardly onto the tape through the open end of the cop, the cop having on the upper edge of its outlet opening, a downwardly inclined guide tooth for facilitating the egress of the spiral element from the cop.

Means are preferably provided for introducing a jet of air into the cop through a nozzle inclined to the axis of the cop and directed towards the outlet of the said cop. The cop may be assembled in the loom such that its height and its position in directions both transverse and longitudinally of the lock stitch needle can be adjusted.

According to a further preferred embodiment of the invention, the loom is provided with a movable peg which in use of the loom is lowered to engage the weft thread before the entry of the weft thread inserting member into an open shed of warp threads, in order to ensure that the weft thread loop is formed at a constant distance from the warp threads, and is raised to disengage it from the weft thread before the end of withdrawal of the inserting member from the shed.

Two embodiments of the method according to the invention will now be more particularly described, by way of example, with reference to the accompanying drawings, in which.

Corresponding parts are indicated by identical reference numbers in the drawings.

Figure 1:
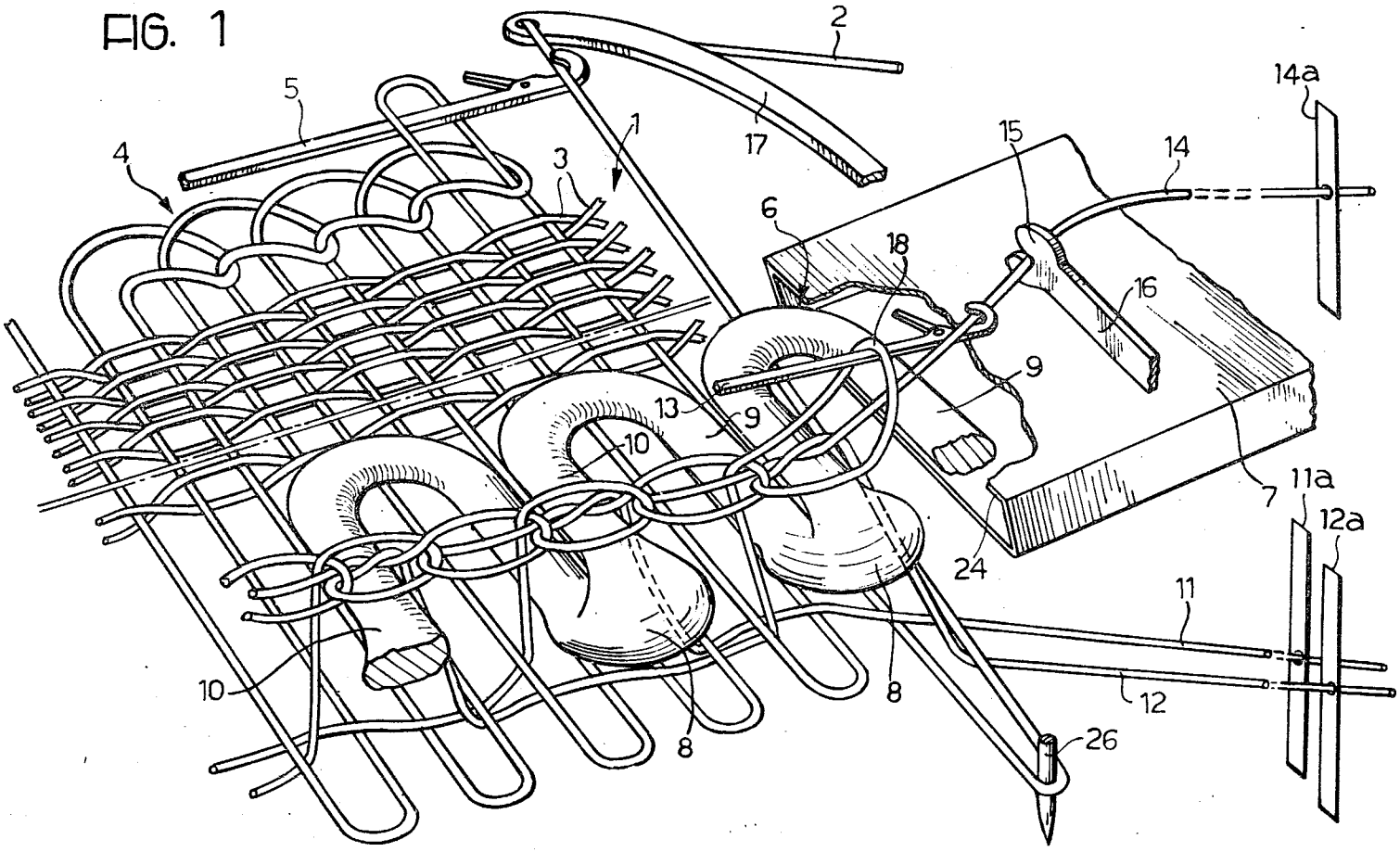
FIG. 1 is a diagrammatic perspective view, on an enlarged scale, of a sliding-clasp fastener tape during its manufacture by a first embodiment of the method according to the present invention and of parts of a shuttleless loom according to the invention on which the tape is made.
Figure 2:
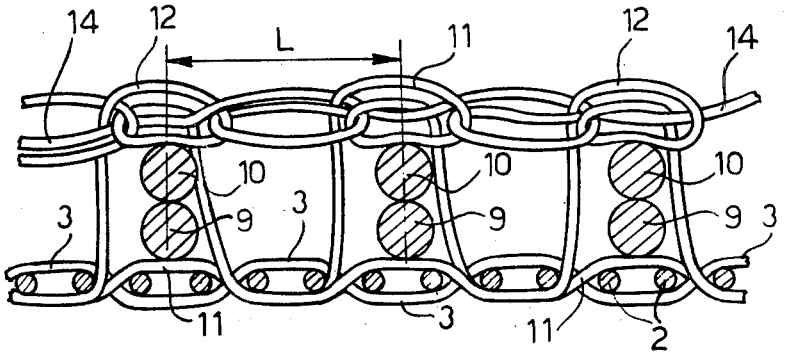
FIG. 2 is a longitudinal sectional view taken close to the edge of the tape of FIG. 1.

Referring to FIGS. 1 and 2, a tape, generally indicated 1, is shown comprising loops of a weft thread 2 entwined with warp threads 3 (only some of which are shown) in the usual manner, and bound together along a selvedge to form a chain binding generally indicated 4, with the aid of a lock stitch needle 5. A member driven for reciprocating movement transverse the warp threads 3 to insert lengths of the weft thread into the warp shed is shown at 17.

A spiral element 6 forming teeth for cooperation with a sliding-clasp fastener is superimposed upon a marginal part of the tape 1 opposite the selvedge bearing the chain binding 4, the spiral element 6 being fed on to the upper surface of the tape 1, as seen in the drawings, by known means, through a cop 7, the open end of which faces downwardly towards the tape 1. The cop 7 is spaced from a working zone in which the tape is being made by a distance equal to the shed L of the spiral element 6 and is inclined at an angle of about 20° to the plane of formation of the tape 1.

The spiral element 6 consists of a thread of plastics material shaped as a distorted helix, having upper and lower arms, 10 and 9 respectively, extending perpendicular the length of the tape 1, the arms 9, 10 being arranged in pairs such that each arm 10 lies above an arm 9 to which it is connected by a loop head 8, the loop heads 8 being located above the said marginal part of the tape 1. Further, each arm 9 lies above two adjacent lengths of the weft thread 2 which will be termed "a loop".

The spiral element 6 is attached to the tape 1 by means of warp threads 11 and 12 which are located in the said marginal part of the tape 1 and which are formed into loops which project above the spiral element 6 and are locked, by a locking thread 14, into a chain binding with the aid of an auxiliary lock stitch needle 13 which extends parallel to the length of the tape 1 above the spiral element 6.

In greater detail, the warp thread 11 is formed into a loop above a superimposed pair of the transverse arms 9 and 10 of the spiral element 6 and the loop of the weft thread 2 beneath these arms is returned to the tape to pass below the next loop of the weft thread, passes between the next pair of arms 9 and 10 and loop of weft thread immediately below them, below the next adjacent weft thread loop and rises up from the tape 1 above the subsequent superimposed pair of arms 9 and 10 and weft thread loop beneath them, and is itself again formed into a loop, before being returned once more to the tape 1. Thus the warp thread 11 passes over and under alternate pairs of arms 9 and 10. The thread 12 is made to carry out similar movements, passing over the arms 9 and 10 which the thread 11 passes under the vice versa and the loops of the threads 11 and 12 above the arms 9, 10 are interconnected by means of the locking thread 14 to form the chain binding.

Figure 4:
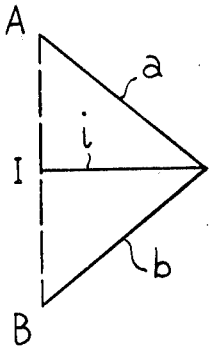
FIG. 4 is a diagram illustrating positions taken up by warp threads for attaching a spiral element to the sliding-clasp fastener tape of FIGS. 1 and 2, or 3, and levels taken up by healds which form part of the shuttleless loom and which control the movements of these threads.

The formation of the loops of the warp threads 11, 12 is brought about by movement of respective healds 11*a* and 12*a*, shown diagrammatically, which control the positions of the threads 11 and 12 during formation of the tape 1. The healds 11*a* and 12*a* are located to one side of the tape and on that side of the cop 7 opposite the lock stitch needle 5, and can move between an upper level A, lower level B and intermediate level I, illustrated in FIG. 4, the respective threads controlled by the healds taking up the positions shown respectively as a, b, and i in the FIG. 4. A further heald 14*a* controls the movement of the locking thread 14 and can move between the upper level A and intermediate level I, the thread 14 taking up the corresponding position a or i.

Figure 5:
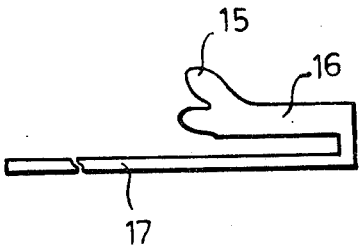
FIG. 5 is a side elevational view of a weft thread inserting member and an attached forked guide member which form part of the loom shown in FIG. 1.

When one of the said threads 11, 12, 14 takes up the position a, it is engaged by a forked end 15 of an upper guide member 16 which is attached to the weft thread inserting member 17 as shown in FIG. 5. During insertion of a loop of the weft thread 2 in an open shed of the warp threads 3 by the member 17 the thread in position a is carried by the guide member 16 into the position, illustrated with reference to the locking thread 14 in FIG. 1, in which it can be grasped by the auxiliary lock stitch needle 13. The thread 14 and needle 13 reach this position, in which the hooked end of the needle 13 is in an advanced position, above the cop 7, at the end of the weft insertion stroke. During the withdrawal of the inserting member 17 from the warp shed, the auxiliary lock stitch needle 13 is retracted to a withdrawn position, in which its hooked end is above the tape 1 which has been formed on the loom, and pulls the thread 14 which it has grasped through a loop 18 borne by the shank of the said needle 13.

The heald 14*a* which controls the position of the locking thread 14 reaches the upper position A during the insertion of a loop of the weft thread 2 immediately beneath the spiral 6 and below the space separating two successive pairs of transverse arms 9 and 10 of the spiral element 6. The heald 14*a* assumes the intermediate position I when the loop of the weft thread 2 is formed below the superimposed pairs of said arms 9 and 10; the locking thread 14 is then situated below the plane in which the auxiliary lock stitch needle 13 operates and above the plane in which the weft thread inserting member 17 moves.

Each of the healds 11*a* and 12*a* which control the positions of the warp threads 11 and 12, on the other hand, carries out the following sequence of movements. From the upper level A in which the respective thread 11 or 12 is engaged by the forked end 15 of the guide member 16 and carried by this into engagement with the hook of the auxiliary lock stitch needle 13, the respective heald descends towards the lower level B, the descent commencing after the insertion of a loop of the weft thread 2 below a pair of transverse arms 9 and 10 of the spiral element 6. The heald remains at this level during the insertion of the next loop of the weft thread 2 in the warp shed, rises to the intermediate level I, and remains at this level during the formation of another loop of the weft thread 2. The heald then descends to the lower level B at which it stays during the formation of yet another loop of the weft thread 2, after which it rises to the upper level A and the cycle of movements recommences.

Figure 6:
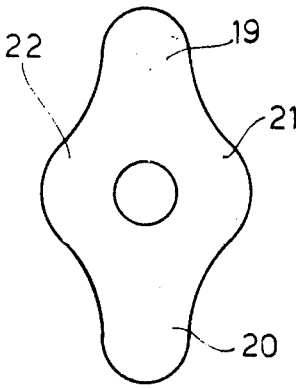
FIG. 6 is a side elevational view of a cam which controls the movement of a heald between the positions shown in FIG. 4.

Each of the cams for controlling the movements of the healds 11*a* and 12*a* which control the positions of the warp threads 11 and 12 has the form illustrated in FIG. 6 and comprises two similar longer, lobes 19 and 20, symmetrical relative to each other, and interconnected by two similar, symmetrical, shorter lobes 21 and 22. These cams are carried on the same drive shaft (not shown) but are staggered by 90°.

Figure 8:
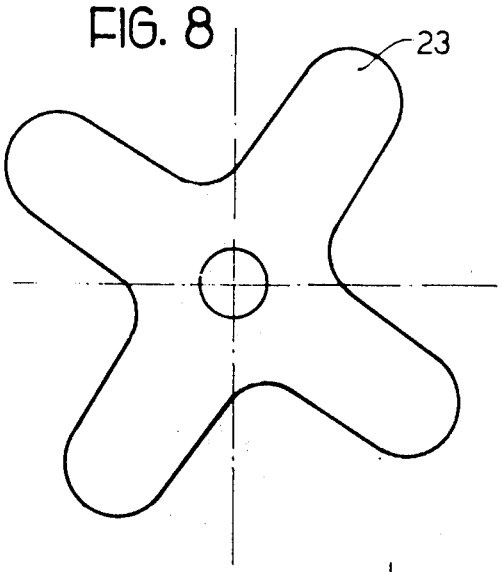
FIG. 8 is a side elevational view of a cam which controls the movements of a heald through which a locking thread, used in the method illustrated in FIGS. 1 and 2 or 3 is fed.

The cam for controlling the movements of the heald 14*a* which controls the position of the locking thread 14 is illustrated in FIG. 8 and comprises four similar, equally spaced lobes 23, the cam having a minimum diameter equal to the maximum diameter of the lobes 21 and 22 of the cam of FIG. 6. It is also staggered angularly about its axis by 45° with respect to the cam of FIG. 6.

Figure 7:
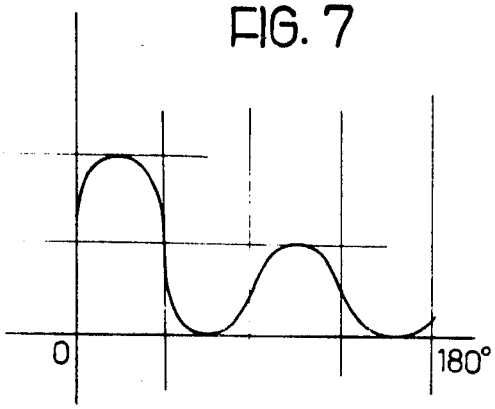
FIG. 7 is a diagram illustrating the movements of the heald controlled by the cam of FIG. 6.
Figure 9:
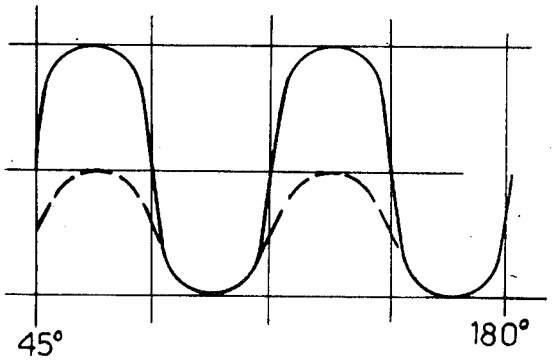
FIG. 9 is a diagram illustrating the movements of the heald controlled by the cam of FIG. 8.

Referring to FIGS. 7 and 9, the movements of the healds 11*a* and 12*a* controlling the movements of the threads 11 or 12 and 14 respectively are shown graphically,. In each FIG. 7 or 9 the ordinate represents the movements of the respective heald, and the abscissa represents the angle of rotation of the shaft supporting the respective cam.

Referring again to FIG. 1 of the drawings, a downwardly facing upper edge 24 of the opening of the cop 7 is provided centrally with a tooth 25 (shown in FIG. 3) which facilitates egress of the spiral element 6 from the cop. The cop 7 may effect reciprocating movements in a direction parallel the longitudinal axis of the tape 1.

During formation of the tape 1 by the method illustrated in FIGS. 1 and 2, a feed movement of the cop 7 is effected while either of the warp threads 11 and 12 is situated above the transverse arms 9 and 10 of the spiral element.

Figure 3:
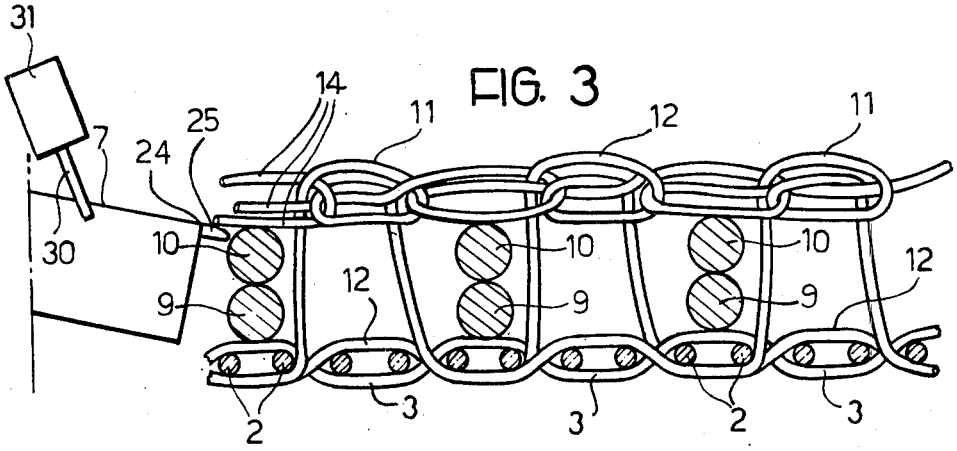
FIG. 3 is a longitudinal sectional view corresponding to that of FIG. 2, relating to a second embodiment of the method according to the invention.

During formation of the tape by the method illustrated in FIG. 3, the movement takes place when either the weft threads 11 and 12 is brought up from the foundation tape to form a loop between successive pairs of the arms 9 and 10 of the spiral element 6.

The emergence of the spiral element from the cop 7 is further facilitated by a continuous or intermittent jet of air which is introduced from a source 31 through a nozzle 30 spaced from the open end of the cop 7 and inclined to the longitudinal axis of the cop, the nozzle 30 being directed towards the outlet of the cop 7. A further advantage of this system is that the jet of air keeps the cop clean.

The cop 7 is mounted in the loom such that its height above the tape 1, and its position in directions both transverse and longitudinally of the tape 1, can be adjusted.

A movable peg 26 is provided in order to ensure that the point of formation of a loop of the weft thread 2, prior to its insertion into the sheds of the warp threads 3, is spaced at a constant distance from the outermost thread 3 on that edge of the tape 1 above which the spiral element 6 is located. The peg 2 is lowered shortly before the entry of the weft thread inserting member 17 into the shed of the warp threads 3 and engages the weft thread 2. When the member 17 is withdrawn from the shed, the peg is withdrawn upwards, in order to disengage the weft thread 2.

According to the second method, illustrated in FIG. 3, the cams which control the movements of the healds 11*a*, 12*a* and 14*a* which control the positions of the warp threads 11 and 12 and the locking thread 14 respectively are arranged at an angle of 45° to the positions previously described with reference to FIGS. 6 to 9. Thus the loops of the warp threads 11 and 12 respectively are formed over alternating spaces between successive pairs of superimposed transverse arms 9 and 10 of the spiral element 6, and the loops of the chain binding made by the locking thread 14 are located above the successive pairs of the said transverse arms 9, 10.

Whereas embodiments of the method according to the invention have been described in which a locking thread 14 is employed to lock together loops of the warp threads 11 and 12, the locking thread may be dispensed with and the loops of warp thread bound directly together to form the chain binding. In this case the loops of one warp thread may be formed over successive superimposed pairs of arms 9 and 10 of the spiral element 6 while the loops of the other warp thread may be formed over the gaps which separate successive pairs of the said arms.

If only one warp thread is used for fastening the spiral to the foundation tape, it embraces successive pairs of transverse arms 9 and 10, and it may be formed into a chain binding either with or without a locking thread 14.

These different types of chain bindings may be made by modifying the cam illustrated in FIG. 6, and possibly also the control which operates the auxiliary lock stitch needle 13.

We claim:

1. A method for the manufacture of a fabric tape for use in making sliding-clasp fasteners, comprising a plurality of warp threads, a weft thread formed into loops and interwoven with said warp threads, a selvedge formed by connecting said weft thread loops into a chain binding and having a spiral element superimposed upon a marginal part of the tape opposite said selvedge and secured to said tape during the weaving thereof, wherein at least one of said warp threads located in said marginal part of the tape is formed into loops which are brought through said spiral element to project above the latter and locking said loops together above said spiral element by means of a locking thread which is disposed completely above said spiral element to form a chain binding fastening said spiral element to said tape.

2. A method as in claim 1 wherein said warp thread is passed over arms of said spiral element, which extend substantially perpendicular the length of said tape, said loops being formed directly above said arms.

3. A method as in claim 1, wherein said warp thread loops are formed in and project above spaces between arms of said spiral element which extend substantially perpendicular the length of said tape.

4. A method as in claim 1, wherein said chain binding is formed by two of said warp threads located in said marginal part of said tape.

* * * * *